US005684443A

United States Patent [19]

Runyan et al.

[11] Patent Number: 5,684,443

[45] Date of Patent: Nov. 4, 1997

[54] FALSE-TRIP-RESISTANT CIRCUIT BREAKER

[75] Inventors: Daniel James Runyan, Cambridge, Md.; Kevin Edward Weidner, Harrisburg, Pa.

[73] Assignee: Philips Electronics North America Corporation, New York, N.Y.

[21] Appl. No.: 576,550

[22] Filed: Dec. 21, 1995

[51] Int. Cl.[6] ..... H01H 9/00

[52] U.S. Cl. ..... 335/177; 335/183

[58] Field of Search ..... 335/177–83, 172–6

[56] References Cited

U.S. PATENT DOCUMENTS

| | | | |
|---|---|---|---|
| 2,439,165 | 4/1948 | Graves, Jr. . | |
| 2,817,730 | 12/1957 | Wilckens . | |
| 3,805,113 | 4/1974 | Freidrich . | |
| 4,439,803 | 3/1984 | Baba . | |
| 4,502,086 | 2/1985 | Ebisaka . | |
| 4,876,521 | 10/1989 | Boyd | 335/179 |
| 5,053,736 | 10/1991 | Fasano | 335/177 |

FOREIGN PATENT DOCUMENTS 8603348 6/1986 WIPO .

OTHER PUBLICATIONS

Derwent's Abstract, No. 90–5978/01, Week 9001, Abstract of SU, 1488889 (Stavropol Poly), 23 Jun. 1989.

*Primary Examiner*—Lincoln Donovan
*Attorney, Agent, or Firm*—Robert J. Kraus

[57] ABSTRACT

A circuit breaker includes a coil arrangement for actuating an armature to open the breaker. To prevent false tripping during high transient currents drawn by a load, the coil arrangement has first and second coils, electrically connected in series. The second coil is interposed between the first coil and the armature and is wound in an opposite direction from the first coil to produce an opposing field.

7 Claims, 3 Drawing Sheets

FALSE-TRIP-RESISTANT CIRCUIT BREAKER

BACKGROUND OF THE INVENTION

1. Field of the Invention

The invention relates to electrical-power-interrupter devices and, in particular, to a circuit breaker with means for preventing false tripping.

2. Description of Related Art

In some applications circuit breakers are utilized to protect electrical loads having high initial inrush currents. To avoid false tripping of a breaker during such initial inrush currents, it is known to include in the breaker mechanical and/or electronic means for delaying tripping during transient overcurrent conditions. FIG. 1 illustrates one type of known circuit breaker which is particularly effective in such applications. The illustrated breaker comprises a plastic housing in which are secured a switch 30, a switch control arrangement including a toggle lever 32 and an armature A, both mechanically connected to the switch by linkage 33, and an armature actuation arrangement including a pole piece P, a core assembly M, and a coil L.

The switch 30 includes a contact 30A, which is affixed to one end of a conductive line terminal $T_A$, and a contact 30B, which is affixed to one end of a conductive arm 34 that is pivotable around a pin 36. Arm 34 is electrically connected to one end of the coil L through a conductive lead 37. The opposite end of the coil is electrically connected to a conductive load terminal $T_B$ through another conductive lead 35. The linkage 33 is pivotably attached to the switch arm 34 (by a pin 38) and to the toggle lever 32 (by a pin 40) such that, when the toggle lever is pivoted clockwise around a pin 42, the linkage latches the switch 30 in a closed state with the contacts 30A and 30B forced together.

The armature A is a magnetically-permeable metal member which, together with an integral arm 44, is pivotable around a pin 46 secured in an L-shaped magnetically-permeable metal frame 48. This frame has an opening 50 in which the core assembly M is secured. The core assembly includes a cup-shaped tubular member 52 formed of non-magnetic material, such as copper, which is closed at its top end by the pole piece P to form a sealed container. This container is filled with a damping fluid, such as silicone oil (not visible in the figure), in which a solid tubular delay core 54 of magnetically-permeable material, such as non-leaded 1010 steel, is immersed. The delay core 54 has a reduced-diameter portion 54A for supporting a cylindrical spring 56 which extends from a ridge 54B to the pole piece P. The delay core 54 is shorter in length than the tubular member 52, but is of sufficient length to extend from the pole piece P to the opening 50 when positioned against the pole piece P.

During steady-state operation of the known circuit breaker shown in FIG. 1, current supplied by a source (not shown) that is connected to line terminal $T_A$ passes through the closed switch 30, through coil L, and to a load connected to load terminal $T_B$. As the current passes through the coil L, it produces a torroidal magnetic field having a concentration of flux lines in the magnetically-permeable delay core 54. The force developed by this field urges core 54 toward pole piece P to eliminate the gap between them. However, spring 56 produces a counteracting force which is sufficient to prevent the core from moving toward the pole piece at all currents below the rated tripping current of the breaker.

During the occurrence of transient moderate-overload currents, such as 125–200% of the rated breaker tripping current, the force developed by the coil field overcomes the spring force and the core 54 begins to move through the obstructing damping fluid toward the pole piece P. The viscosity of the damping fluid determines how quickly the core moves, and thus determines how long the transient must last before the core reaches the pole piece. If the core reaches the pole piece, it cooperates with the L-shaped magnetically-permeable frame 48 to form a U-shaped magnetic circuit that is separated from the armature A by air gaps G1 and G2, causing flux lines to concentrate in these two gaps. These flux lines develop sufficient force to instantly close the air gaps G1 and G2, by causing the armature A to pivot around pin 46 against the force of a return spring (not shown). As this happens, integral arm 44 pushes against a lever 58 of the linkage 33 causing unlatching and opening of the switch 30, thereby interrupting current flow to the load.

During the occurrence of high overload currents, such as 500% or greater, the flux in gaps G1 and G2 is sufficient to cause the armature to close these air gaps, thereby instantaneously opening the switch 30. This is undesirable if the load is of a type which typically draws such currents during startup. Examples of such loads are electronic circuits with highly capacitive input impedances and low-resistance motor windings. The known armature actuation arrangement of the type illustrated in FIG. 1 cannot be easily modified to solve this problem. If the delay is increased by, for example, reducing the number of turns in the coil L and/or increasing the force of the armature return spring and/or increasing the gaps G1/G2, the circuit breaker could lose its ability to interrupt a low-level continuous overcurrent (e.g. 125%).

SUMMARY OF THE INVENTION

It is an object of the invention to provide an electromagnetically-operated circuit breaker including simple means for maintaining the breaker in the closed state during predetermined transient high-overcurrent conditions.

It is another object to provide such a circuit breaker which trips substantially instantaneously upon the occurrence of a destructive overcurrent condition.

In accordance with the invention, a circuit breaker of the above-described type comprises an armature actuation arrangement including first and second coils arranged around a tubular core-holding member. The first coil is wound for conducting current in a first direction around a first length of the tubular member which is remote from an attached pole piece which defines the air gap with the armature. The second coil is wound for conducting current in the opposite direction around a second length of the tubular member which is proximate the pole piece. In response to current flowing through the breaker switch, the first coil produces a first magnetic field acting on the core and urging it toward the pole piece to effect actuation of the armature. In response to at least a portion of the current flowing through the breaker switch, the second coil produces a second magnetic field which opposes and has a smaller strength than the first magnetic field. This opposition field will increase the delay for high overload currents, but will not prevent tripping of the breaker for low-level overload currents. At currents above a predetermined level, the effect of the first coil will dominate and the breaker will trip instantaneously. The specific currents at which delayed or instantaneous tripping occurs can be adjusted by adjusting the relative strengths of the fields produced by the first and second coils.

DESCRIPTION OF THE PREFERRED EMBODIMENTS

Figure 1:
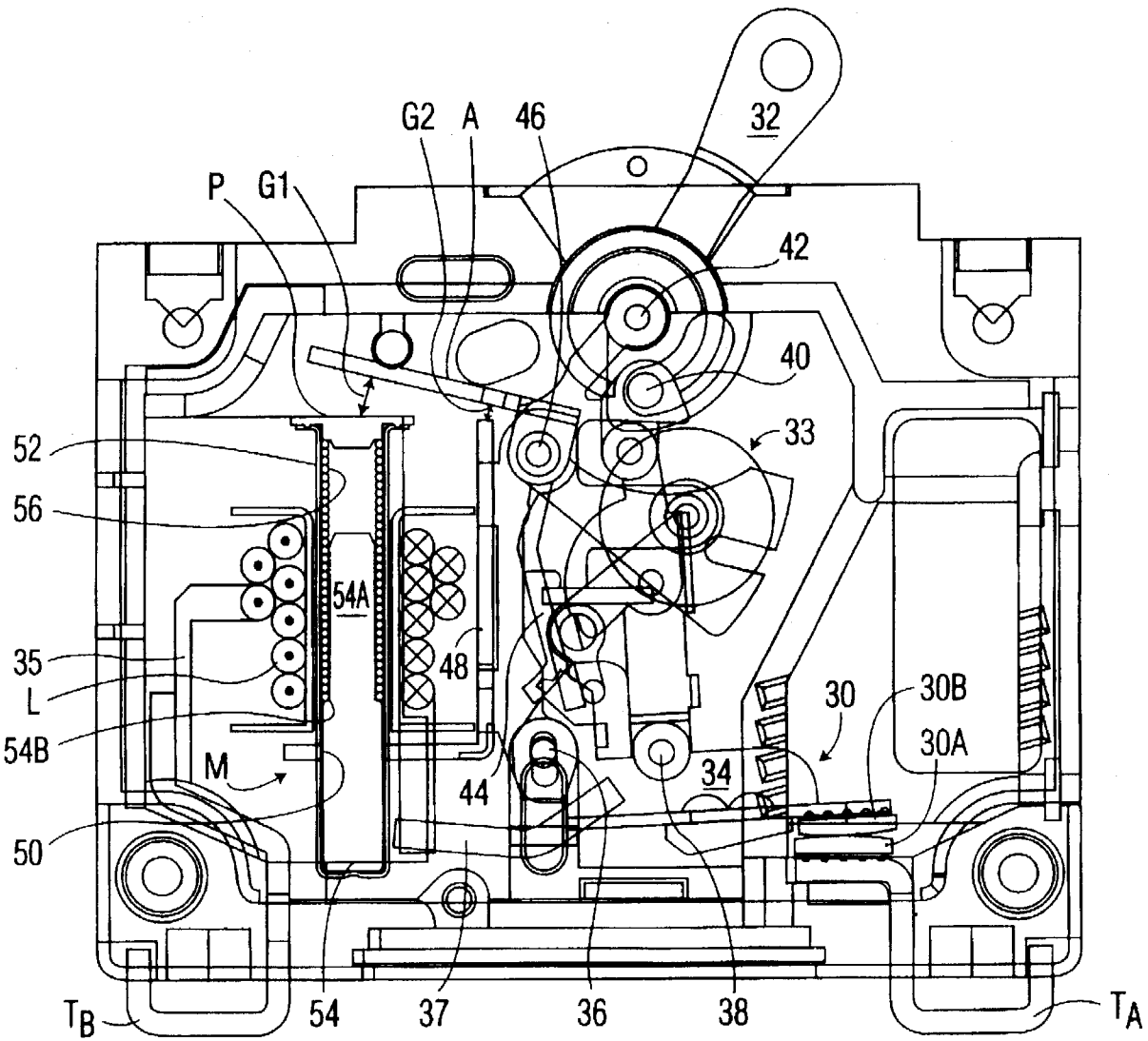
FIG. 1 a cross-sectional view of a known circuit breaker.
Figure 2:
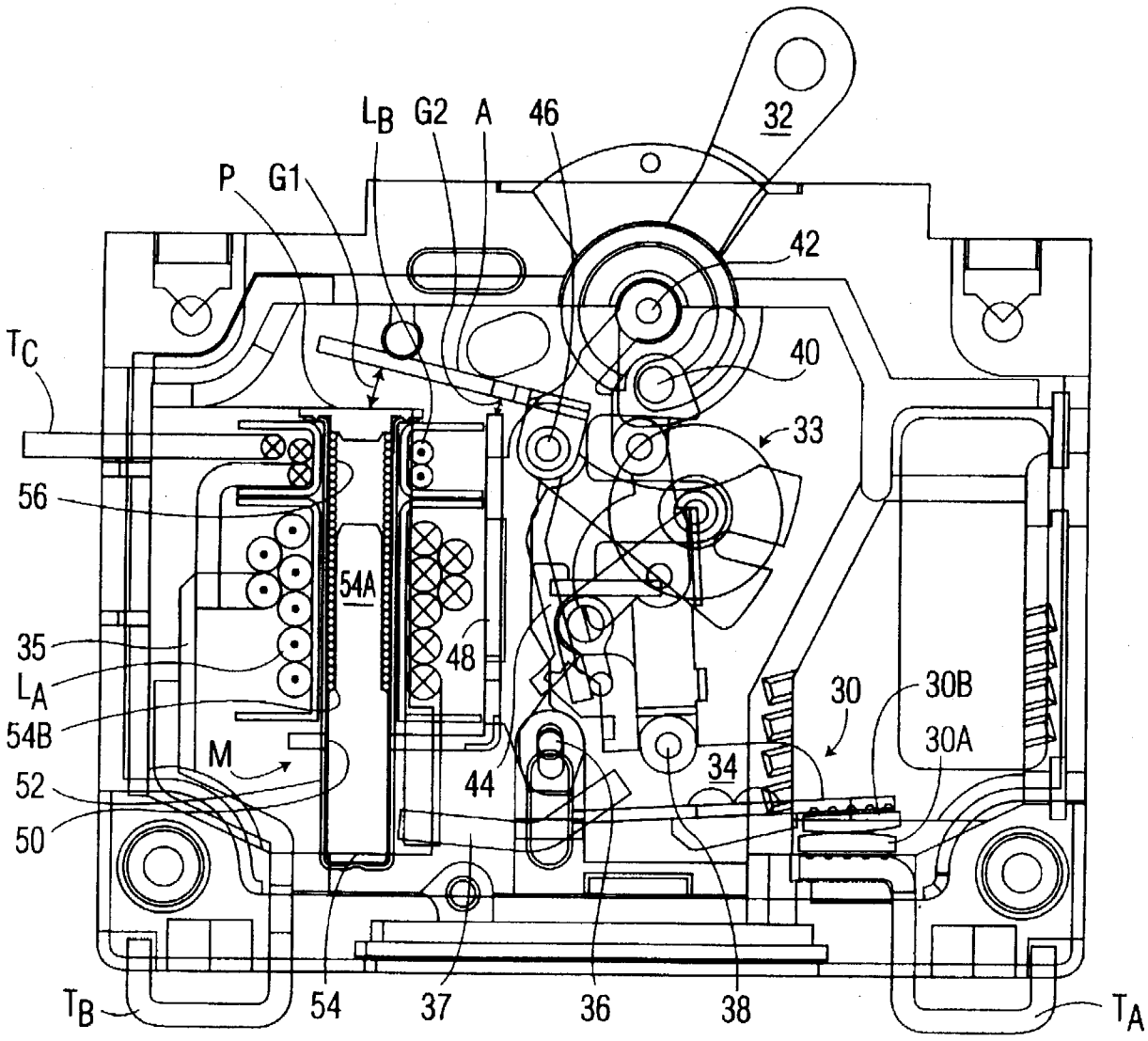
FIG. 2 is a cross-sectional view of an embodiment of a circuit breaker in accordance with the invention.

FIG. 2 illustrates a circuit breaker which is similar to that of FIG. 1, but which has been modified in accordance with a preferred embodiment of the invention. Identical parts in both figures are identified with the same reference numbers. More specifically, the first and second coils in this embodiment are identified as $L_A$ and $L_B$, respectively. The directions of the windings are indicated by the cross-sectional symbol "●" for current flowing out of the page and the symbol "x" for current flowing into the page. One end of the coil $L_A$ is electrically connected to the switch arm 34 through conductor 37, one end of coil $L_B$ serves as a terminal $T_C$, and the opposite ends of these coils are electrically connected at a junction point to a lead 35, which is connected to terminal $T_B$. Thus the switch 30 and the coils are electrically connected in series between the terminals $T_A$ and $T_C$, while terminal $T_B$ provides a connection to the junction where the coils are connected to each other.

The increased delay provided by the circuit breaker of FIG. 2 is believed to occur because of a localized negative influence of the magnetic field produced by coil $L_B$ on the field produced by coil $L_A$. That is, the field produced by coil $L_B$ weakens the field produced by coil $L_A$ in the vicinity of the armature A and pole piece P to a greater extent than it weakens it in the vicinity of the core 54. Thus, when an overcurrent condition begins, the core moves more slowly toward the pole piece P. Once it reaches the vicinity of the pole piece, however, the breaker will trip if the resultant flux in the air gap is sufficient to move the armature A.

The third terminal $T_C$ enables an alternative usage for the circuit breaker of FIG. 2. It enables the breaker to be utilized in a power distribution network where a circuit breaker must protect an upstream circuit, while also providing current to a second circuit breaker, or other type of current interrupter device, which protects a downstream circuit. A problem which occurs in such a network is that, when a short circuit occurs in the downstream circuit, it will cause opening of not only the locally-affected current interrupter device, but also of the upstream circuit breaker.

Figure 3:
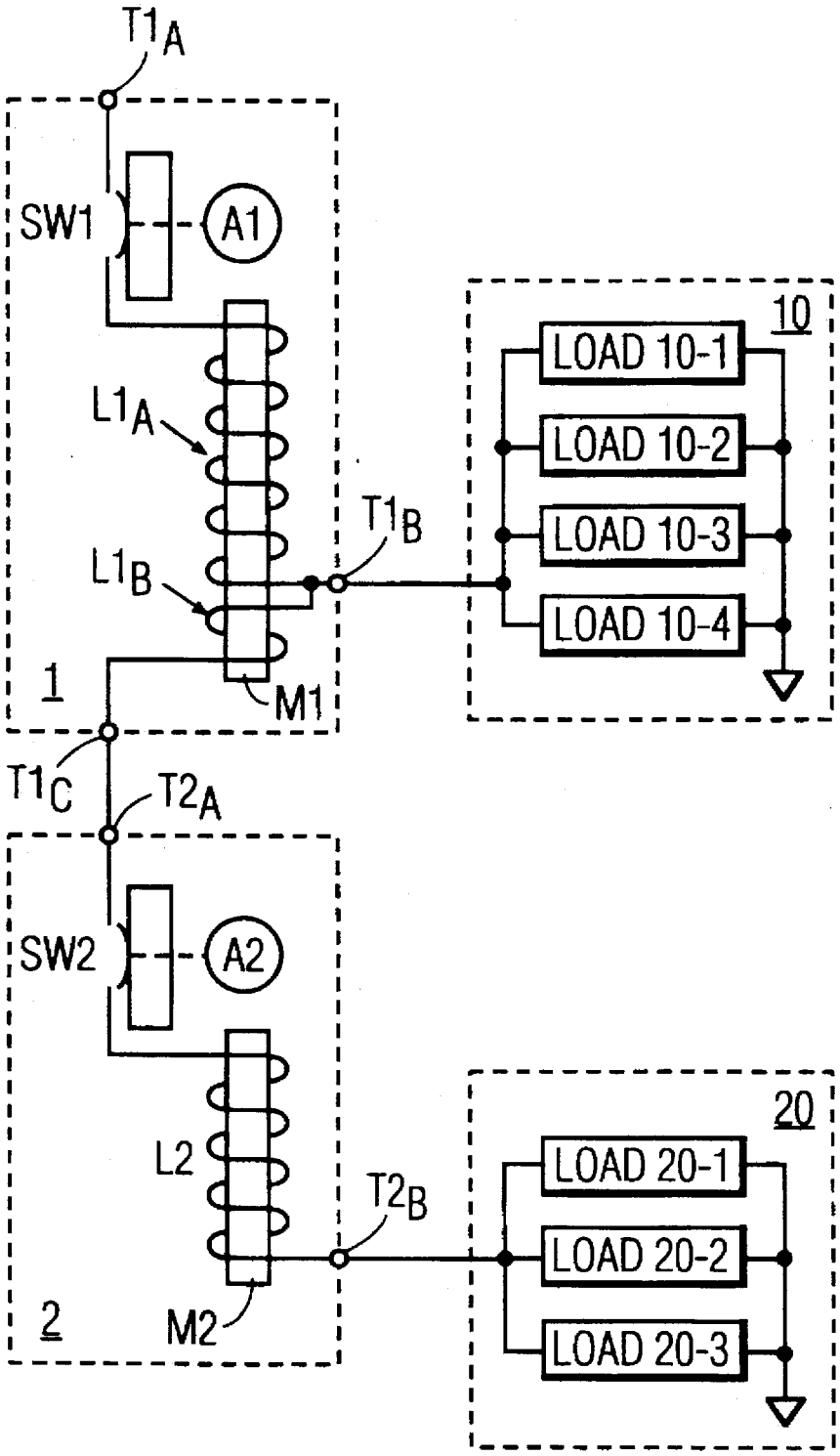
FIG. 3 is a schematic circuit diagram illustrating a simple power distribution network incorporating a circuit breaker in accordance with the invention.

FIG. 3 illustrates utilization of a circuit breaker 1, of the type illustrated in FIG. 2, in such a network. The circuit breaker 1 provides power directly to a circuit 10, including parallel-connected loads 10-1, 10-2, 10-3, 10-4, and indirectly (via a downstream, serially-connected, conventional circuit breaker 2 having a lower current rating) to a circuit 20, including parallel-connected loads 20-1, 20-2, 20-3. For the sake of brevity, only this simple two-breaker, two-circuit network will be described to explain operation of the invention. However, one or more circuit breakers in accordance with the invention can be utilized advantageously in networks of much greater complexity or in networks which substitute a different type of power interrupter device, such as a fuse, for the conventional downstream circuit breaker 2.

The circuit breaker 1 includes a line terminal $T1_A$ for connection to a source of electric current, a first load terminal $T1_B$ for supplying current directly to the circuit 10, and a second load terminal $T1_C$ for supplying current indirectly to the circuit 20, through the circuit breaker 2. The terminals $T1_A$, $T1_B$ and $T1_C$ correspond to terminals $T_A$, $T_B$ and $T_C$ in FIG. 2. Similarly, breaker 1 includes switch SW1, armature A1, and coils $L1_A$ and $L1_B$ corresponding to switch 30, armature A, and coils $L_A$ and $L_B$ in the breaker of FIG. 2. The circuit breaker 2 includes a line terminal $T2_A$, which is electrically connected to load terminal $T1_C$, for receiving current from circuit breaker 1, and a load terminal $T2_B$ connected to the circuit 20.

The conventional circuit breaker 2 includes an electromagnetically-actuated switch SW2 through which the current supplied to circuit 20 must pass. It also includes a coil L2 which is electrically connected in series with the switch SW2 for sensing this current. The coil L2 is wound around a magnetically-permeable core M2, which is disposed proximate an armature A2 for actuating switch SW2, thereby interrupting current flow to circuit 20, if a rated current for breaker 2 is exceeded.

In operation, the tripping characteristics of breaker 1 are dependent on the currents drawn by both circuits. In a first situation, where circuit 20 draws no current, the reverse winding $L1_B$ will not produce any field and breaker 1 will respond to current flowing in circuit 10 similarly to the breaker of FIG. 1. In a second situation, where circuit 10 draws no current, breaker 1 will respond to the load current drawn from terminal $T1_C$ as described in connection with the description of FIG. 2. In the expected situation, where current is drawn by both circuits, operation of breaker 1 will fall somewhere between the first and second situations. In any situation, provided that circuit breaker 2 is functioning correctly, a destructive overload at terminal $T2_B$ will cause it to trip without causing tripping of circuit breaker 1.

We claim:

1. A circuit breaker including a line terminal for electrical connection to a source of electric current, a load terminal for supplying electrical current to a load, said terminals being electrically connected through switch means having a closed state and an open state, switch control means including an armature for, upon actuation, effecting opening of said switch means, and an armature actuation arrangement for effecting actuation of said armature upon the occurrence of a predetermined overcurrent condition, said arrangement including:

a. a tubular member in which is movably disposed a core comprising magnetically permeable material, said member supporting a pole piece comprising magnetically permeable material which is disposed adjacent the armature to define an air gap when the switch means is in the closed state, said tubular member having a first length remote from the pole piece and a second length proximate said pole piece;

b. biasing means for urging the core away from the pole piece to a position where said core is remote from the pole piece;

c. a first coil wound around the first length of the tubular member for conducting current in a first direction, in response to current flowing through said switch means, and producing a first magnetic field acting on the core and urging said core toward the pole piece to effect actuation of the armature; and d. a second coil electrically connected in series with the first coil and wound around the second length of the tubular member for conducting current in a direction which is opposite the first direction, in response to at least a portion of the current flowing through said switch means, and producing a second magnetic field which opposes and has a smaller strength than the first magnetic field.

2. A circuit breaker as in claim 1 where the first coil has more turns than said second coil.

3. A circuit breaker as in claim 1 where the switch means and the first and second coils are electrically connected in series with each other between the line terminal and the load terminal, said first coil having more turns than said second coil.

4. A circuit breaker as in claim 1 where the tubular member contains a fluid for impeding movement of the core toward the pole piece.

5. A circuit breaker as in claim 1 where the biasing means comprises a spring.

6. A circuit breaker which is adapted for providing electric current to a first circuit and to a power interrupter device through which the electric current is provided to a second circuit, said circuit breaker including:

a. a line terminal for electrical connection to a source of electric current;

b. a first load terminal for supplying a first electrical current to the first circuit;

c. a second load terminal for supplying a second electrical current to the power interrupter device;

d. switch means having a closed state and an open state, said switch means enabling electric current flow from the line terminal to the first and second load terminals when in the closed state and preventing said current flow when in the open state;

e. switch control means including an armature for, upon actuation, effecting changing of said switch means from the closed state to the open state;

f. an armature actuation arrangement for effecting actuation of the armature upon the occurrence of a predetermined overcurrent condition, said arrangement including:

i. a tubular member a tubular member in which is movably disposed a core comprising magnetically permeable material, said member supporting a pole piece comprising magnetically permeable material which is disposed adjacent the armature to define an air gap when the switch means is in the closed state, said tubular member having a first length remote from the pole piece and a second length proximate said pole piece;

ii. biasing means for urging the core away from the pole piece to a position where said core is remote from the pole piece;

iii. a first coil wound around the first length of the tubular member for conducting current in a first direction around said tubular member and producing a first magnetic field acting on the core and urging said core toward the pole piece to effect actuation of the armature, said field having a strength which varies with the sum of the first and second currents;

iv. a second coil electrically connected in series with the first coil and wound around the second length of the tubular member for conducting current in a direction which is opposite the first direction and producing a second magnetic field which opposes the first magnetic field and has a strength which varies with the second current and is smaller than the first magnetic field.

7. A circuit breaker as in claim 6 where:

a. the strength of the first magnetic field is a predetermined first percentage of the sum of the first and second currents;

b. the strength of the second magnetic field is a predetermined second percentage of the second current; and c. the first percentage is substantially larger than the second percentage.

* * * * *